US005487490A

United States Patent [19]

Estes

[11] Patent Number: 5,487,490

[45] Date of Patent: Jan. 30, 1996

[54] PRODUCT DISPENSER WITH AIR DISPLACEMENT DEVICE

[75] Inventor: David W. Estes, Arlington, Tex.

[73] Assignee: CODEV Corp., Rockford, Ill.

[21] Appl. No.: 352,532

[22] Filed: Dec. 9, 1994

Related U.S. Application Data

[63] Continuation of Ser. No. 220,907, Mar. 30, 1994, abandoned.

[51] Int. Cl.[6] ..... B65D 35/28; B65D 37/00

[52] U.S. Cl. ..... 222/1; 222/95; 222/105; 222/212; 222/386.5

[58] Field of Search ..... 222/1, 95, 105, 222/212, 213, 490, 386.5

[56] References Cited

U.S. PATENT DOCUMENTS

| | | | |
|---|---|---|---|
| 1,650,966 | 11/1927 | Smith | 222/490 |
| 1,752,085 | 3/1930 | Hinkle | 222/212 |
| 2,715,980 | 8/1955 | Frick | 222/212 X |
| 2,876,935 | 3/1959 | Lindberg | 222/212 X |
| 2,898,007 | 8/1959 | Gassaway | 222/212 |
| 3,203,247 | 8/1965 | Bicek | 222/212 |
| 3,223,289 | 12/1965 | Bouet | 222/95 X |
| 3,319,837 | 5/1967 | Mueller | 222/212 |
| 3,365,105 | 1/1968 | Krizka | 222/95 X |
| 4,154,366 | 5/1979 | Acres | 222/212 |
| 4,295,582 | 10/1981 | Acres | 222/213 |
| 4,909,416 | 3/1990 | Evezich | 222/105 X |
| 5,234,688 | 8/1993 | Gaffar | 222/105 X |
| 5,318,204 | 6/1994 | Davis et al. | 222/212 X |

*Primary Examiner*—Andres Kashnikow
*Assistant Examiner*—Kenneth Bomberg
*Attorney, Agent, or Firm*—James E. Bradley; Mark W. Handley

[57] ABSTRACT

A method and apparatus are provided for dispensing a food product from a plastic squeeze bottle, which includes a bottom, a top, and resilient sidewalls. A displacement orifice extends into the plastic squeeze bottle for passing ambient air into an inflatable element disposed within the plastic squeeze bottle. A check valve retains the ambient air within the inflatable element. The inflatable element has an expandable wall which separates the ambient air from the food product contained within the bottle. Expansion of the inflatable element presses the expandable wall between resilient sidewalls and urges the food product to flow through a dispensing orifice and from the bottle. A dispenser tip extends across the dispensing orifice for passing the food product therethrough, and preventing ambient air from entering the plastic squeeze bottle through the dispensing orifice.

20 Claims, 4 Drawing Sheets

PRODUCT DISPENSER WITH AIR DISPLACEMENT DEVICE

CROSS REFERENCE TO RELATED APPLICATIONS

This application is a continuation-in-part of related application Ser. No. 08/220,907, filed Mar. 30, 1994, and entitled "Product Dispenser With Air Displacement Device."

BACKGROUND OF THE INVENTION

1. Field of the Invention

This invention relates in general to product dispensers, and in particular to plastic squeeze bottles for dispensing food condiments.

2. Description of the Prior Art

Product dispensers, such as plastic squeeze bottles, have been provided for dispensing products, such as food condiments. Such plastic squeeze bottles typically have a top and resilient sidewalls which together define a volume for containing the product until dispensed. A dispensing orifice typically extends through the top of the plastic squeeze bottle for passing the product from the bottle. External pressure is usually applied to the resilient sidewalls of the plastic squeeze bottle to urge the product to flow therefrom.

A problem arises in that products, such as food condiments, are subject to spoilage when exposed to ambient air. After a portion of the product is dispensed from a plastic squeeze bottle, releasing the pressure to allow the resilient sidewalls to return to their original shape will draw air into the plastic container. This exposes the product to ambient air and thus causes a reduced shelf life for the product once it is partially dispensed.

Another problem arises with this type of prior art dispenser in that very often food condiments are viscous, and thus tend to not flow very easily. When a small portion of the product is remaining within the dispenser bottle, very often the small portion is difficult to remove. The food product will stick to the interior wall of the plastic dispenser, and must be removed by either a violently shaking the dispenser, scraping the interior wall of the dispenser with a utensil, or mixing another fluid with the product to reduce the tackiness of the food product. Otherwise, the product remains within the dispenser and is wasted.

The above two problems often combine to increase the amount of food product wasted by dispensing from prior art product dispensers. Air exposure tends to remove moisture from products, often increasing the viscosity and causing the food product to become tackier and stick tighter to the interior walls. Thus, not only is waste increased by air exposure causing spoilage, but the product becomes more difficult to remove from the interior walls of the dispensing container.

SUMMARY OF THE INVENTION

A method and apparatus are provided for dispensing a food product from a plastic squeeze bottle, which includes a bottom, a top, and resilient sidewalls. A displacement orifice extends into the plastic squeeze bottle for passing ambient air into an inflatable element disposed within the plastic squeeze bottle. A check valve retains the ambient air within the inflatable element. The inflatable element has an expandable wall which separates the ambient air from the food product contained within the bottle. Expansion of the inflatable element presses the expandable wall between resilient sidewalls and urges the food product to flow through a dispensing orifice and from the bottle. A dispenser tip extends across the dispensing orifice for passing the food product therethrough, and preventing ambient air from entering the plastic squeeze bottle through the dispensing orifice.

BRIEF DESCRIPTION OF THE DRAWINGS

The novel features believed characteristic of the invention are set forth in the appended claims. The invention itself however, as well as a preferred mode of use, further objects and advantages thereof, will best be understood by reference to the following detailed description of an illustrative embodiment when read in conjunction with the accompanying drawings, wherein:

DETAILED DESCRIPTION OF THE PREFERRED EMBODIMENT

Figure 1:
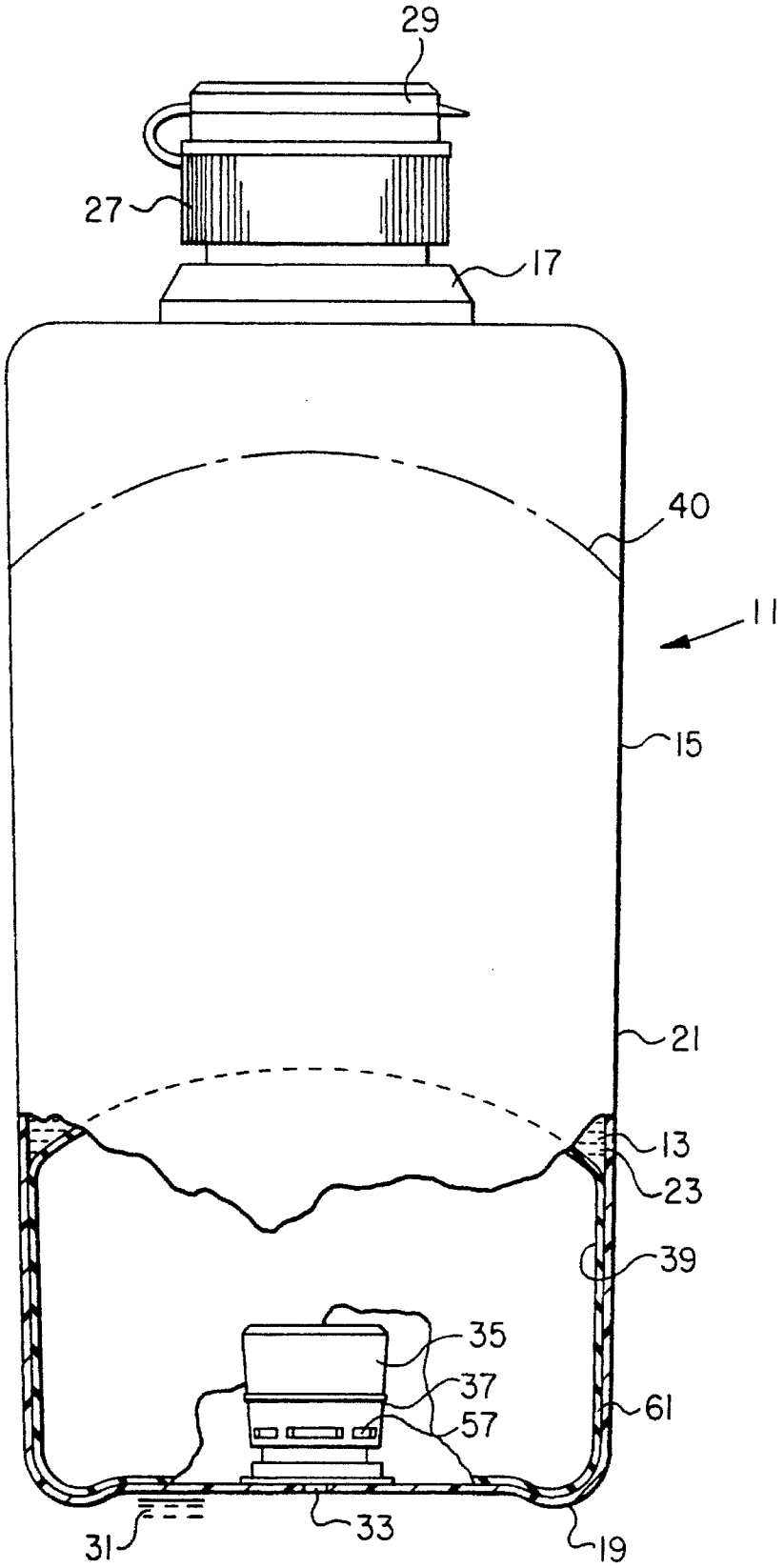
FIG. 1 is a cutaway view depicting the product dispenser of the preferred embodiment of the present invention which includes a plastic squeeze bottle and an air displacement device.

Referring to FIG. 1, a cutaway view depicts product dispenser 11 of the present invention. Product dispenser 11 is for dispensing a product 13, such as a food product or food condiment.

Product dispenser 11 includes plastic squeeze bottle 15. Bottle 15 has top 17, bottom 19, and resilient sidewall 21, which together define volume 23 on the interior of plastic squeeze bottle 15. Resilient sidewall 21 is formed of a singular surface having a cylindrical shape. However, in other embodiments of the present invention, resilient sidewalls may be provided which are contoured to provide a flat surface on either side of a plastic squeeze bottle.

Dispensing orifice 25 (shown in FIG. 3) extends through top 17 of plastic squeeze bottle 15 for passing product 13 from the interior of bottle 15. Bottle cap 27 is provided for enclosing dispensing orifice 25, and includes lid 29 for selectively sealing plastic squeeze bottle 15.

Displacement orifice 33 extends through bottom 19. Air displacement device 35 is secured to receive ambient air 31 from displacement orifice 33. Ambient air 31 is air which initially surrounds plastic squeeze bottle 15. Air displacement device 35 includes check valve 37 and inflatable element 39.

In the preferred embodiment, inflatable element 39 is a bladder, similar to a balloon element. Inflatable element 39 is shown partially inflated within plastic squeeze bottle 15. Further, inflatable element is depicted in an almost fully inflated position by phantom line 40. Inflatable element 39 includes expandable wall 61.

Figure 2:
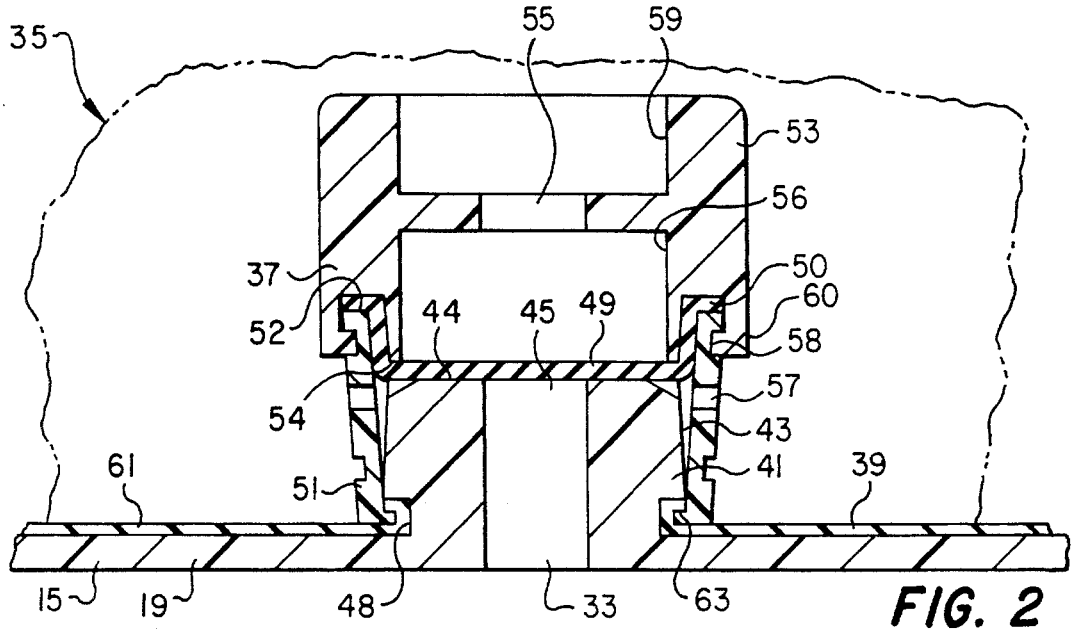
FIG. 2 is a sectional view depicting the check valve used in the product dispenser of the preferred embodiment of the present invention.

Referring to FIG. 2, a sectional view depicts check valve 37 in bottle 15. Check valve 37 includes nipple 41, diaphragm 49, element retainer 51, and nipple cap 53. Nipple 41 provides a valve body for check valve 37. Nipple cap 53 seats on top of element retainer 51 with diaphragm 49 held therebetween. Element retainer 51 seats on nipple 41, with inflatable element 39 held around nipple 41 by retainer 51. In the preferred embodiment, element retainer 51 and nipple cap 53 are cylindrical in shape. Further, nipple 41 is cast into the bottom of bottle 15. In alternative embodiments of the present invention, an alternative nipple may be secured to bottom 19 by other methods, such as will be discussed below in more detail.

Nipple 41 is a valve body having an exterior surface 43 and hole 45, which extends through the interior of nipple 41. Since nipple 41 is molded into bottle 15, hole 45 provides displacement orifice 33 in this preferred embodiment of the present invention. Exterior surface 43 includes top surface 44 into which notches 47 extend. Top surface 44 extends around the upper end of hole 45 to provide a seal surface. In the preferred embodiment, top surface 44 is a flat planar seal surface and notches 47 are four V-shaped notches which extend into an edge of top surface 44 of nipple 41, similar to notches 97 shown in FIG. 6. In other embodiments according to the present invention, a seal surface may be provided having other shapes, such as an arcuate surface. Notches 47 are equally spaced about the edge of surface 44 and provide flow ports through the edge of surface 44. Exterior surface 43 is contoured and includes groove 48 which extends completely around an exterior circumference of surface 43, similar to exterior surface 93 and groove 95 shown in FIG. 6. Groove 48 provides a recessed lip for element retainer 51 to grip against to remain seated onto nipple 41.

Element retainer 51 has shoulder 52 and lip 63. Lip 63 snaps into place within groove 48 to hold retainer 51 in place, seated on top of nipple 41. The edges of inflatable element 39 are flexible, and extend between lip 63 and the surface of groove 48 for holding inflatable element 39 in position on bottom 19 of bottle 15 for receiving ambient air from check valve 37. The top of element retainer 51 extends to provide shoulder 52, against which nipple cap 53 presses ear 50 of diaphragm 49. A groove 58 extends exteriorly around an upper portion of retainer 51.

Nipple cap 53 includes a lower portion with an interiorly extending lip 60 for securing within groove 58 to secure nipple cap 53 to retainer 51. Nipple cap 53 seat on retainer 51, with diaphragm 49 held in place between nipple cap 53 and element retainer 51. Nipple cap 53 has hole 55. Slits 57 are provided in retainer 51, and are spaced circumferentially around retainer 51. Recess 59 extends interiorly within nipple cap 53 for providing a space for containing most of inflatable element 39 during installation of air displacement device 35 into bottle 15 and filling of bottle 15 with product 13 (shown in FIG. 1). Cavity 56 is provided above diaphragm 49 so that the weight of product within bottle 15 will not push downward onto diaphragm 49 and prevent diaphragm 49 from lifting to pass air in response to negative pressures.

Diaphragm 49 extends over the top of hole 45. Diaphragm 49 is a cut from a sheet of flexible, resilient, elastomeric material. Diaphragm 49 is stretched between retainer 51 and nipple cap 53, being held in place by shoulder 54 of nipple cap 53 and shoulder 52 of retainer 51, when cap 53 and retainer 51 are snapped together to seat cap 53 on the top of retainer 51. Shoulder 54, which is a circumferentially extending shoulder of nipple cap 53, then presses diaphragm 49 into seal surface 44. Ear 50 is the end of diaphragm 49 which bends around shoulders 52 and 54 as nipple cap 53 is seated onto retainer 51.

Element retainer 51 and nipple cap 53 are sized so that shoulder 54 will press diaphragm 49 downward onto the top of nipple 41. The pressure of shoulder 54 pressing diaphragm 49 downward urges diaphragm 49 to seal around the exterior of hole 45 and prevent air from flowing outwardly from within inflatable element 39 and through hole 45. However, since diaphragm 49 is formed of a flexible, elastomeric material, negative pressure within plastic squeeze bottle 15 will lift the central portion of diaphragm 49 away from the top of nipple 41 so that ambient air will be able to flow through hole 45, underneath diaphragm 49, through notches 47 and slits 57, and into the interior of inflatable element 39. Thus, diaphragm 49 provides the operative sealing element for check valve 37, and notches 47 provide flow ports for passing air between diaphragm 49 and the top of nipple 41.

Negative pressures are herein defined as interior pressures within plastic squeeze bottle 15 which are less than the atmospheric pressure surrounding the exterior of plastic squeeze bottle 15. Thus, when negative pressures are within bottle 15, ambient air will tend to flow into bottle 15.

It should be noted that in other embodiments of the present invention, a shoulder is not required, such as shoulder 54, to press diaphragm 49 downward. Rather, diaphragm 49 may be biased by other means. For example, the weight of product 13 within bottle 15 may provide a biasing means to press diaphragm 49 into seal surface 44. Additionally, since inflatable element 39 is formed from an elastomeric material in this preferred embodiment, the elasticity of expandable wall 61 will also provide a biasing means for pressing diaphragm 49 into seal surface 44 since it will maintain a positive pressure on top of diaphragm 49 once expanded by ambient air. Thus, diaphragm 49 will press downward to provide a positive seal for retaining air within inflatable element 39.

Figure 3:
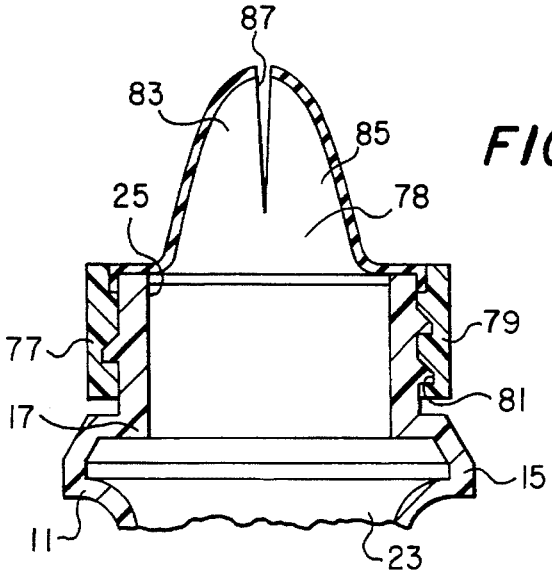
FIG. 3 is a sectional view depicting a dispenser tip for use with the product dispenser of the present invention.

Referring to FIG. 3, a sectional view depicts dispenser tip 77 for securing to the top of product dispenser 11. Dispenser tip 77 includes first section 79 which preferably is a ring with threads 81 which may be secured to the top of product dispenser 11. Dispenser tip 77 further includes flexible member 78 which is secured between top 17 of plastic squeeze bottle 15 and ring 79. Flexible member 78 has a second section 83 and third section 85, which are formed in dispenser tip 77 with slit 87 extending therebetween. Slit 87 is aligned for passing product from volume 23 and dispensing orifice 25 to the exterior of dispenser 11.

In the preferred embodiment of the present invention, plastic squeeze bottle 15 is made from a thermosetting plastic material. Inflatable element 39 and flexible member 78 of dispenser tip 77 are formed from elastomeric materials, such as latex. Element retainer 51, nipple cap 53 and ring 79 of dispenser tip 77 are formed from thermosetting plastic materials. Diaphragm 49 is formed from an elastomeric type material, such as latex rubber. Thus, air displacement device 35 is formed from low cost plastic and rubber materials. It should also be noted that in the preferred embodiment of the present invention, the materials used for forming product dispenser 11 should be approved for use with food products.

Operation of product dispenser 11 is now described. Referring to FIG. 1, inflatable element 39 is shown partially inflated within plastic squeeze bottle 15. Prior to use, plastic squeeze bottle 15 will be full of product 13, and inflatable element 39 will be fully deflated. Lid 29 of cap 27 is then lifted to open dispensing orifice 25 (shown in FIG. 3). In the embodiment shown, plastic squeeze bottle 15 is then placed over a receptacle, such as a plate or the like, and resilient sidewall 21 is squeezed to urge product 13 from within plastic squeeze bottle 15. Squeezing of resilient sidewall 21 reduces volume 23, which is inside plastic squeeze bottle 15. The pressure is then released from resilient sidewall 21, so that resilient sidewall 21 returns to its original shape and volume 23 returns to its original size.

Referring to FIG. 2, check valve 37 is shown in a closed position to prevent ambient air from flowing from within inflatable element 39. Release of resilient sidewall 21 (shown in FIG. 1), so that volume 23 (shown in FIG. 1) returns to its original size, creates negative pressure on the interior of nipple cap 53. This negative pressure causes diaphragm 49 to lift upwardly (not shown in FIG. 2) so that ambient air will pass through hole 45, beneath diaphragm 49, through notches 47 and slits 57, and into the interior of inflatable element 39. Thus, inflatable element 39 is expanded, or enlarged in shape, to occupy the volume of product dispensed from within plastic squeeze bottle 15. Check valve 37 will retain ambient air within inflatable element 39.

Referring again to FIG. 1, squeezing resilient sidewall 21 again will create a positive pressure, which is a pressure which is greater than the pressure of ambient air 31 disposed about the exterior bottle 15. This positive pressure again urges product 13 to flow from squeeze bottle 15, and check valve 37 to remain closed and prevent the ambient air which is inside inflatable element 39 from being pushed outwardly through displacement orifice 33. Releasing resilient sidewall 21 causes more of ambient air 31 to flow through hole 45 to further inflate inflatable element 39.

Inflatable element 39 expands to conform to the interior shape of resilient sidewall 21 of plastic squeeze bottle 15. Inflatable element 39 is formed to expand at the bottom of bottle 15 first so that product 13 will not become trapped between bottom 19 and inflatable element 39. By conforming to the interior shape of sidewall 21 of plastic squeeze bottle 15, product 13 is pressed outward from between sidewall 21 and expandable wall 61, and ahead of inflatable element 39 so that product 13 will be removed and not stick to the interior surface of resilient sidewall 21. Thus, product 13 will be pushed from within bottle 15, and violent agitation or scraping with utensils will not be required to remove product 13 from within plastic squeeze bottle 15. Further, positive pressure within inflatable element 39 presses against check valve 37 to provide a positive seal for retaining the air within inflatable element 39 as discussed above.

Referring to FIG. 3, dispenser tip 77 is shown with slit 87 in a partially open position. When food products are being urged from within dispenser 11, pressure applied to the interior of second section 83 and third section 85 will open slit 87 and push the product therethrough. Once a desired amount of product is discharged from within dispenser 11, flexible member 78 of dispenser tip 77, which is made from elastomeric materials, will again close to prevent ambient air 31 from passing through orifice 25 and into dispenser 11.

Dispenser tip 77 is useful with products having a low viscosity, such as picante sauces or oily salad dressings. Lower viscosity condiments flow easier than higher viscosity condiments, and thus they may be pulled back into dispenser 11 when sidewall 21 is released before inflatable element 39 has time to inflate. This can cause air to be drawn into volume 23 where condiments are stored, and thus can contaminate or remove moisture from the condiments, rather than the air being drawn into inflatable element 39. Dispenser tip 77 provides a means for restricting air flow into volume 23 with product 13 so that air will instead flow through check valve 37 and into inflatable element 39 (shown in FIG. 2).

Dispenser tip 77 is also particularly useful when dispensing products of varying consistencies. For example, often food condiments have vegetables which are mixed with a liquid, such as a picante sauce. When slit 87 is partially open for dispensing the food condiment from within dispenser 11, it will restrict flow of the liquid until a vegetable particle begins to pass through slit 87, then slit 87 will enlarge for passage of that vegetable particle. After passage of the particle, slit 87 will return to its intermediate size for dispensing so that a large amount of liquid will not rush through slit 87. Thus, splattering of the product is avoided.

Figure 4:
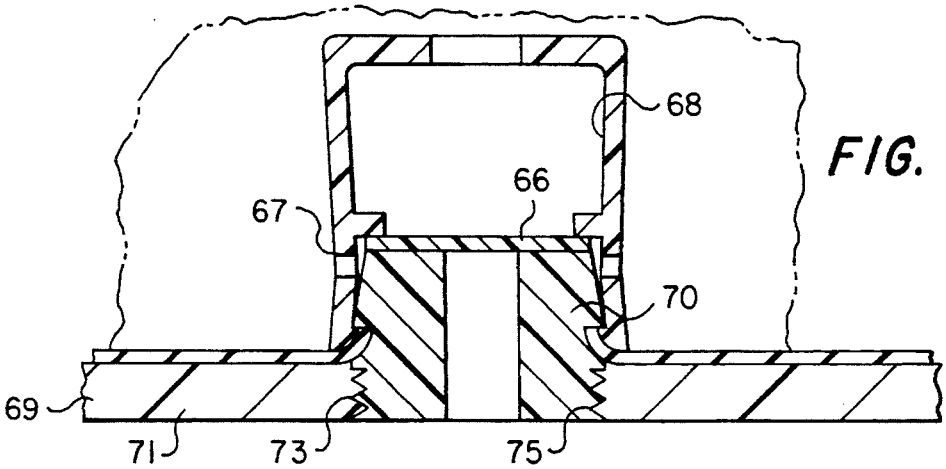
FIG. 4 is a sectional view depicting a check valve assembly of an alternative embodiment of the check valve used in a product dispenser of the present invention.

Referring to FIG. 4, check valve 67 is an alternative embodiment to check valve 37. Check valve 67 is for use with alternative plastic squeeze bottle 69 which has a thicker portion 71 in the bottom. Nipple, or valve body, 70 has exterior threads 73 which extend through thicker portion 71 of bottle 69 for mating with interior threads 75 of portion 71. In this alternative embodiment, check valve 67 is secured within plastic squeeze bottle 69 by means of threads 73, 75. Cavity 68 is provided above diaphragm 66 so that the weight of product within bottle 69 will not push downward onto diaphragm 66 and prevent diaphragm 66 from lifting to pass air in response to negative pressures.

Figure 5:
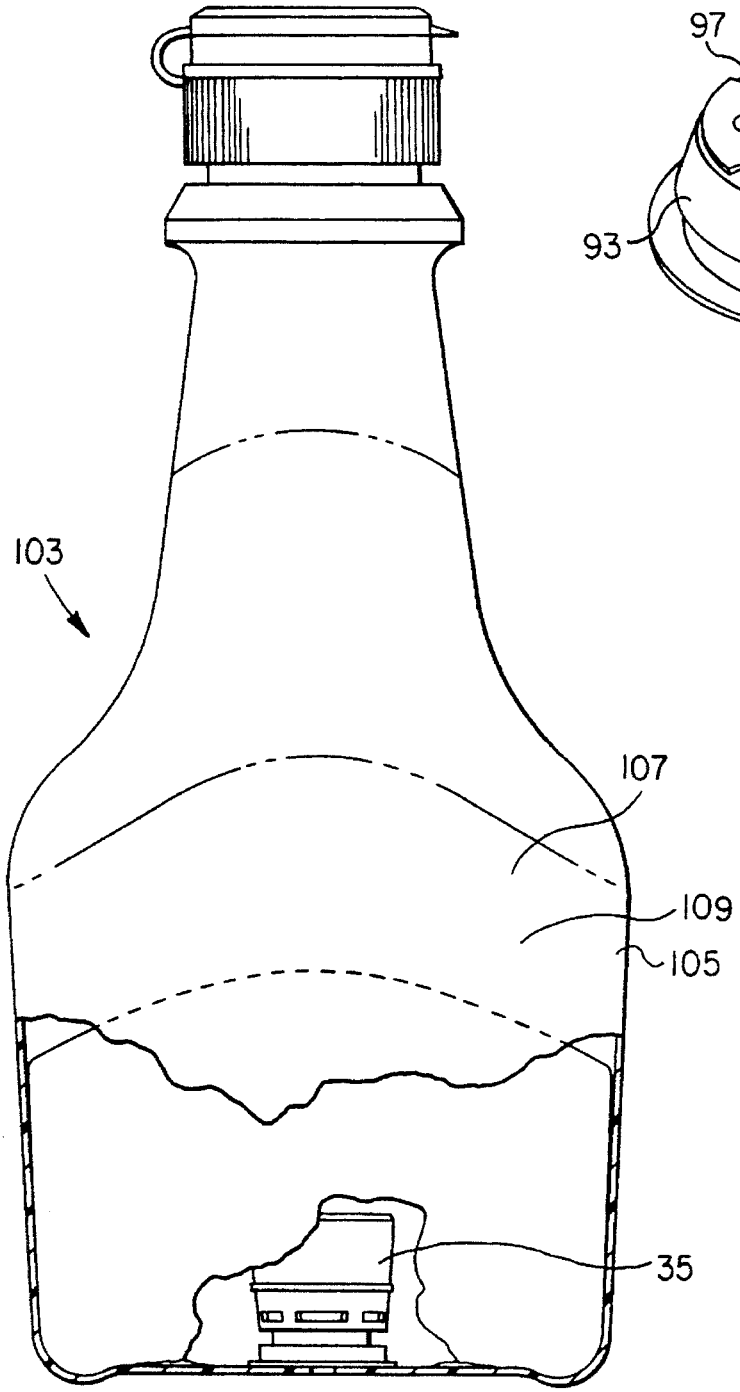
FIG. 5 is a sectional view of a product dispenser of an alternative embodiment of the present invention, which includes a plastic squeeze bottle having flat sidewalls.

Referring to FIG. 5, a sectional view depicts product dispenser 103 of an alternative embodiment of the present invention. Product dispenser 103 includes plastic squeeze bottle 105 having resilient sidewalls 107 (one shown), which are contoured to provide flat surfaces 109 (one shown) on two sides of bottle 105. Flat surfaces 109 are pressed together to urge product from bottle 105. Product dispenser 103 is also depicted to include air displacement device 35.

Figure 6:
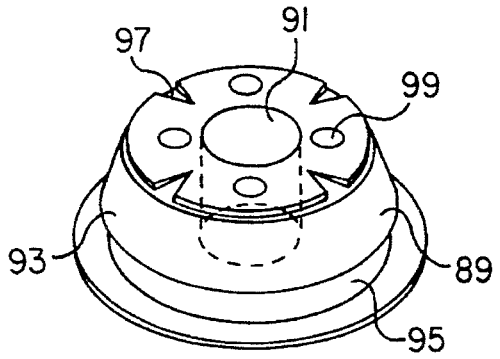
FIG. 6 is a perspective view depicting a nipple which is used in an alternative check valve assembly of the air displacement device of the product dispenser of the present invention.

Referring to FIG. 6, a perspective view depicts alternative nipple 89 for use in an alternative check valve to check valve 37 (shown in FIG. 1). Nipple 89 is glued to the bottom of an alternative plastic squeeze bottle with an adhesive. Nipple 89 has hole 91 and exterior surface 93 which are similar to hole 45 and exterior surface 43, respectively, of preferred nipple 41 (shown in FIG. 2). Groove 95 extends circumferentially around nipple 89 for receiving lip 63 of element retainer 51 for securing retainer 51, nipple cap 53 and inflatable element 39 thereto (shown in FIG. 2). Notches 97 extend into the exterior surface of nipple 89, and are identical to notches 47 in nipple 41 (shown in FIG. 2). Glue points 99 are positions for placing an adhesive to secure an alternative diaphragm to nipple 89.

Figure 7:
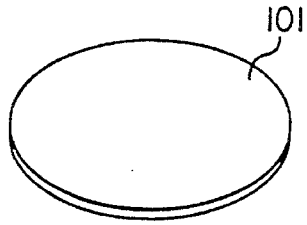
FIG. 7 depicts an alternative diaphragm for use in an alternative check valve assembly of an air displacement device of the present invention.

FIG. 7 is a perspective view depicting alternative diaphragm 101. Referring to FIGS. 6 and 7, diaphragm 101 is for securing across the top of nipple 89 at glue points 99 to enclose hole 91. Positive pressures within hole 91, with respect to the pressures within product dispenser 103 (shown in FIG. 5) push portions of diaphragm 101 upwards. Pushing diaphragm 101 upwards connects hole 91 with notches 97 for passing ambient air between hole 91 and notches 97, and interiorly within an inflatable element according to the present invention, such as inflatable element 39 (shown in FIG. 1).

Figure 8:
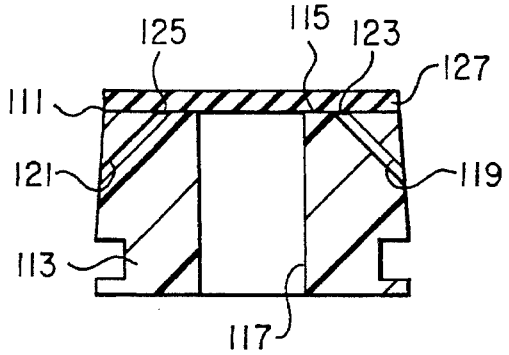
FIGS. 8, 9 and 10 are sectional views of alternative embodiments of components for check valve assemblies according to the present invention.
Figure 9:
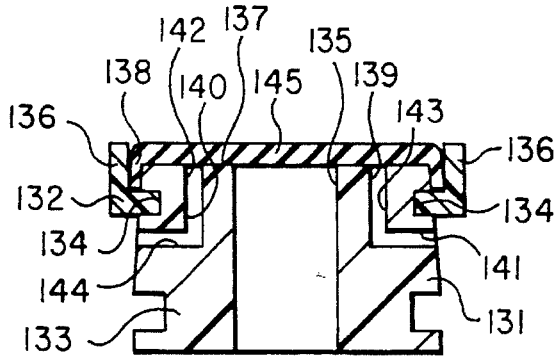
Figure 10:
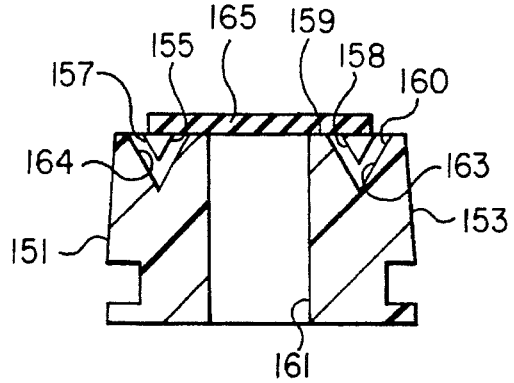

FIGS. 8, 9 and 10 are sectional views of alternative embodiments for nipples, or valve bodies, 113, 133 and 153, and diaphragms 127, 145 and 165, respectively, for check valve assemblies of the present invention. Valve bodies 113, 133 and 153 are depicted for securing by means of an adhesive to the bottom of product dispensers according to the present invention, such as is discussed above for valve body, or nipple, 89 (shown in FIG. 6).

It should be noted that valve bodies, 113, 133 and 153 may be configured for use in place of nipples 41, 70 and 89 of FIGS. 2, 4 and 6, respectively, to provide flow ports which extend through the body of valve bodies rather than notches in an edge of a valve body. However, modifications to nipple caps 53 and 67 of FIGS. 2 and 4, respectively, would be required to provide a flow path beneath shoulders of nipple caps 53 and 67 if a flow port configuration such as shown for flow ports 163, 164 of FIG. 10 is utilized. Further, as discussed above, valve bodies 113, 133 and 153 may also be integrally formed into a product dispenser bottle, secured to a produce dispenser bottle by threads, or secured to a product dispenser bottle by an adhesive.

FIG. 8 depicts check valve assembly 111 which includes nipple, or valve body 113 having a flat, seal surface 115 disposed on one side. An orifice 117 extends through an interior portion of valve body 113 and through flat, seal surface 115. Two ports, 119,121 are apertures which extend interiorly through a portion of valve body 113 from seal surface 115. Ports 119, 121 extend from seal surface 115 at points 123, 125, respectively. Points 123,125 are distal from orifice 117 since they are not connected therewith at seal surface 115. Other ports which are similar to ports 119, 121 may be provided to extend from seal surface 115 to an outer, side surface of valve body 113, spaced apart from one another and from ports 119, 121, such as in a similar fashion to the way notches 97 are spaced apart in nipple 89 (shown in FIG. 6).

Diaphragm 127 is depicted as being secured to valve body 113 above seal surface 115 with an adhesive. Adhesive glue points, such as glue points 99 (shown in FIG. 6), may be provided for securing diaphragm 127 to valve body 113, or the glue may circumferentially extend in a continuous ring around an edge of diaphragm 127. Diaphragm 127 may also be secured to valve body 113 by other means, such as those disclosed herein.

Diaphragm 127 is pressed into seal surface 115 in response to positive pressures within a product dispenser according to the present invention to seal between orifice 117 and flow ports 119, 121. Negative pressures within a product dispenser according to the present invention will lift diaphragm 127 from sealing at seal surface 115 for passing air through orifice 117, between diaphragm 127 and seal surface 115, through flow ports 119, 121 and interiorly into an inflatable element according to the present invention.

FIG. 9 depicts alternative check valve assembly 131 having a nipple which provides valve body 133. Seal surface 137 is a flat, planar seal surface disposed on one side of valve body 133. Orifice 135 extends through a central portion of valve body 113 and centrally through seal surface 137. Flow ports 139, 140 extend from seal surface 137 and interiorly through a portion of valve body 133. Flow port 139 comprises two interconnected apertures 141, 143. Flow port 140 comprises two interconnected apertures 142, 144. Other ports, similar to flow ports 139, 140 may be spaced apart from one another and flow ports 139, 140 to extend from flat seal surface 137 to the side of valve body 133, such as in a similar fashion to the way notches 97 are spaced apart in nipple 89 (shown in FIG. 6). Groove 134 extends circumferentially around an upper exterior portion of valve body 133.

Diaphragm 145 is depicted as having ends 138 secured to valve body 133, above seal surface 137, by means of retaining ring 136. Retaining ring 136 has a circumferentially extending interior lip 132. Diaphragm 145 may also be secured to valve body 133 by other means, such as those disclosed herein. Diaphragm 145 is pressed into seal surface 137 in response to positive pressures within a product dispenser according to the present invention. Pressing diaphragm 145 into seal surface 137 prevents air from flowing between flow ports 139,140 and orifice 135. Negative pressures within a product dispenser according to the present invention will lift diaphragm 145 from pressing into seal surface 137 and allow air to flow through orifice 135, between diaphragm 145 and seal surface 137, through flow ports 139, 140 and interiorly into an inflatable element according to the present invention.

FIG. 10 depicts check valve assembly 151 having a nipple, or valve body 153. Seal surface 159 is provided by a flat surface on one end of valve body 153. Orifice 161 extends through a central portion of valve body 153 and seal surface 159. Flow ports 163, 164 are provided by forming multiple interconnecting apertures 155, 157 and 158, 160, respectively, into valve body 153. Apertures 155, 157, and apertures 158, 160 interconnect in a V-shaped configuration to provide flow ports 163, 164, respectively. Other flow ports may be provided in addition to flow ports 163, 164, spaced apart from one another and flow ports 163, 164, such as in a similar fashion to the way notches 97 are spaced apart in nipple 89 (shown in FIG. 6).

Diaphragm 165 is depicted as being secured to valve body 153, above seal surface 159, with an adhesive. Adhesive glue points, such as glue points 99 (shown in FIG. 6), may be provided for securing diaphragm 165 to valve body and 153, or the glue may circumferentially extend in a continuous ring around an edge of diaphragm 165. Diaphragm 165 may also be secured to valve body 153 by other means, such as those disclosed herein.

Diaphragm 165 is a flexible member provided for pressing into the flat, seal surface 159 to seal between orifice 161 and flow ports 163, 164. Positive pressures within a product dispenser according to the present invention will press diaphragm 165 downward onto flat, seal surface 159 to seal between orifice 161 and flow ports 163,164. Negative pressures within a product dispenser according to the present invention will lift diaphragm 165 from pressing into seal surface 159 and allow air to flow through orifice 161, between diaphragm 165 and seal surface 159, through flow ports 163, 164 and interiorly into an inflatable element according to present invention. It should be noted that apertures 163,164 discharge air from valve body 153 in the same direction at which orifice 161 discharges air from valve body 153.

The present invention has several advantages over prior art product dispensers. The air displacement device provides a means for preventing air drawn within the plastic squeeze bottle of the present invention from contaminating or drying out the product contained within the product dispenser. Additionally, the air displacement device assures that all of the product is evacuated from the bottom of the plastic squeeze bottle first so that an amount of product is not wasted by being left within the interior of the product dispenser. Further, a positive pressure is retained within the air displacement device by both the weight of the product and the resiliency of the elastomeric sidewalls of the inflatable element. The positive pressure provides a positive seal for locking air within an inflatable element of an air displacement device of the present invention.

The dispenser tip prevents air from passing through the dispensing orifice and into contact with the product which remains within the product dispenser of the present invention. The dispenser tip also provides a means for assuring that ambient air is pulled into the inflatable element rather than being pulled into the portion of the container volume where the product is stored. Further, the dispenser tip provides a metering function to prevent splattering of product as it is being dispensed from the product dispenser of the present invention.

Although the invention has been described with reference to specific embodiments, this description is not meant to be construed in a limiting sense. Various modifications of the preferred embodiment as well as alternative embodiments of the invention will become apparent to persons skilled in the art upon reference to the description of the invention. It is therefore contemplated that the appended claims will cover any such modifications or embodiments that fall within the true scope of the invention.

I claim:

1. In a product dispenser having a plastic squeeze bottle which includes a bottom, a top and a resilient sidewall which together define a volume for containing a product therein, a dispensing orifice which extends through the top of the plastic squeeze bottle for passing the product from the volume to an exterior of the plastic squeeze bottle, the improvement comprising:

a displacement orifice which extends through the bottom of the plastic squeeze bottle for passing ambient air into the plastic squeeze bottle in response to negative pressures caused by releasing external pressure applied to the resilient sidewall;

check valve means disposed across the displacement orifice, for passing the ambient air into the plastic squeeze bottle in response to the negative pressures, and for preventing the ambient air from flowing from the plastic squeeze bottle in response to the external pressure being applied to the resilient sidewalls of the plastic squeeze bottle;

inflatable element means having an expandable wall disposed interiorly within the plastic squeeze bottle for receiving the ambient air from the check valve means and the displacement orifice, and expanding against the resilient sidewall in response to the negative pressures, wherein the ambient air is contained within the inflatable element to separate the ambient air from the product and to urge the inflatable element to fill a void within the volume created by evacuating a portion of the product from within the plastic squeeze bottle, and wherein the check valve means prevents the inflatable element from deflating;

wherein the check valve means comprises a nipple having a threaded exterior surface for securing within the displacement orifice, and a hole extending through the nipple for passing the ambient air therethrough; and wherein the check valve means comprises a diaphragm secured to the nipple and adapted to pass the ambient air flowing through the hole and into the inflatable element, and to block the ambient air from passing from the inflatable element and through the hole.

2. In a product dispenser having a plastic squeeze bottle which includes a bottom, a top and a resilient sidewall which define a volume for containing a food product therein, a dispensing orifice which extends through the top of the plastic squeeze bottle for passing the food product from the volume to an exterior of the plastic squeeze bottle, the improvement comprising:

a displacement orifice which extends through the bottom of the plastic squeeze bottle for passing ambient air into the plastic squeeze bottle in response to negative pressures caused by releasing external pressure applied to the resilient sidewall;

check valve means disposed across the displacement orifice, for passing the ambient air into the plastic squeeze bottle in response to the negative pressures, and for preventing the ambient air from flowing from the plastic squeeze bottle in response to the external pressure being applied to the resilient sidewalls of the plastic squeeze bottle;

inflatable element means having an expandable wall disposed interiorly within the plastic squeeze bottle for receiving the ambient air from the displacement orifice and the check valve means, and expanding against the resilient sidewall in response to the negative pressures, wherein the ambient air is contained within the inflatable element means to separate the ambient air from the product and to urge the inflatable element means to fill a void within the volume created by evacuating a portion of the food product from within the plastic squeeze bottle, and wherein the check valve means prevents the inflatable element means from deflating;

wherein the check valve means comprises a nipple having a hole extending therethrough for passing the ambient air into the inflatable element means, a seal surface disposed around an upper end of the hole, and notches extending into an edge of the seal surface, wherein the nipple is disposed in the bottom of the plastic squeeze bottle, across the displacement orifice; and wherein the check valve means further comprises a diaphragm pressed against the seal surface of the nipple to prevent the ambient air from passing from the inflatable element means and through the hole, and wherein the diaphragm is adapted to lift from sealing against the seal surface in response to the negative pressures within the plastic squeeze bottle for passing the ambient air through the displacement orifice, through the hole, between the diaphragm and the seal surface, through the notches, and into the inflatable element means to inflate the inflatable element means.

3. In a product dispenser having a plastic squeeze bottle which includes a bottom, a top and a resilient sidewall which define a volume for containing a food product therein, a dispensing orifice which extends through the top of the plastic squeeze bottle for passing the food product from the volume to an exterior of the plastic squeeze bottle, the improvement comprising:

a displacement orifice which extends through the bottom of the plastic squeeze bottle for passing ambient air into the plastic squeeze bottle in response to negative pressures caused by releasing external pressure applied to the resilient sidewall;

check valve means disposed across the displacement orifice, for passing the ambient air into the plastic squeeze bottle in response to the negative pressures, and for preventing the ambient air from flowing from the plastic squeeze bottle in response to the external pressure being applied to the resilient sidewalls of the plastic squeeze bottle;

inflatable element means having an expandable wall disposed interiorly within the plastic squeeze bottle for receiving the ambient air from the displacement orifice and the check valve means, and expanding against the resilient sidewall in response to the negative pressures, wherein the ambient air is contained within the inflatable element means to separate the ambient air from the food product and to urge the inflatable element means to fill a void within the volume created by evacuating a portion of the food product from within the plastic squeeze bottle, and wherein the check valve means prevents the inflatable element means from deflating;

wherein the check valve means comprises a nipple having a hole extending therethrough for passing the ambient air into the inflatable element means, a seal surface disposed around an upper end of the hole, and notches extending into an edge of the seal surface, wherein the nipple is disposed in the bottom of the plastic squeeze bottle, across the displacement orifice;

wherein the check valve means comprises a diaphragm disposed across the hole and the seal surface of the nipple to selectively prevent the ambient air from passing from the inflatable element means and through the hole;

wherein the check valve means comprises a nipple cap secured to the nipple and having a shoulder which extends to press against the diaphragm and stretch the diaphragm across the hole and the seal surface to urge the diaphragm to seal against the seal surface and prevent ambient air from flowing therethrough; and wherein the diaphragm is formed from flexible material which lifts from sealing against the seal surface in response to the negative pressures within the plastic squeeze bottle, for passing the ambient air through the displacement orifice, through the hole, between the diaphragm and the seal surface, through the notches, and into the inflatable element means to inflate the inflatable element means in response to the negative pressures.

4. In a product dispenser having a plastic squeeze bottle which includes a bottom, a top and a resilient sidewall which define a volume for containing a food product therein, a dispensing orifice which extends through the top of the plastic squeeze bottle for passing the food product from the volume to an exterior of the plastic squeeze bottle, the improvement comprising:

a displacement orifice which extends through the bottom of the plastic squeeze bottle for passing ambient air into the plastic squeeze bottle in response to negative pressures caused by releasing external pressure applied to the resilient sidewall;

check valve means disposed across the displacement orifice, for passing the ambient air into the plastic squeeze bottle in response to the negative pressures, and for preventing the ambient air from flowing from the plastic squeeze bottle in response to the external pressure being applied to the resilient sidewalls of the plastic squeeze bottle;

inflatable element means having an expandable wall disposed interiorly within the plastic squeeze bottle for receiving the ambient air from the displacement orifice and the check valve means, and expanding against the resilient sidewall in response to the negative pressures, wherein the ambient air is contained within the inflatable element means to separate the ambient air from the product and to urge the inflatable element means to fill a void within the volume created by evacuating a portion of the food product from within the plastic squeeze bottle, and wherein the check valve means prevents the inflatable element means from deflating;

wherein the check valve means comprises a nipple having a hole extending therethrough for passing the ambient air into the inflatable element means, a seal surface disposed around an upper end of the hole, a groove which circumferentially extends around the nipple, and notches extending into an edge of the seal surface, wherein the nipple is disposed in the bottom of the plastic squeeze bottle, across the displacement orifice;

wherein the check valve means comprises a diaphragm disposed across the hole and the seal surface of the nipple to selectively prevent the ambient air from passing from the inflatable element means and through the hole;

wherein the check valve means comprises an element retainer disposed around the nipple, the element retainer having an upper shoulder and a lip which extends around the interior of the element retainer for extending into the groove of the nipple to secure the element retainer to the nipple, wherein the lip extends into the groove with an edge of the inflatable element means therebetween to secure the inflatable element means around the check valve means;

wherein the check valve means comprises a nipple cap having a lower shoulder which extends to press against the diaphragm and stretch the diaphragm across the hole and the seal surface to urge the diaphragm to seal against the seal surface and prevent ambient air from flowing therethrough, the lower shoulder of the nipple cap adapted for latching to the upper shoulder of the element retainer to secure the nipple cap to the element retainer and to secure the diaphragm therebetween; and wherein the diaphragm is formed from flexible material which lifts from sealing against the seal surface in response to the negative pressures within the plastic squeeze bottle, for passing the ambient air through the displacement orifice, through the hole, between the diaphragm and the seal surface, through the notches, and into the inflatable element means to inflate the inflatable element means in response to the negative pressures.

5. In a product dispenser of the type having a plastic squeeze bottle with a bottom, a top and a resilient sidewall which define a volume for containing a product therein, a dispensing orifice which extends from within the plastic squeeze bottle for passing the product from the volume to an exterior of the plastic squeeze bottle, an inflatable element having an expandable wall disposed within the plastic squeeze bottle for receiving air from the exterior of the plastic squeeze bottle and expanding against the resilient sidewall in response to negative pressures within the plastic squeeze bottle caused by releasing external pressure applied to the resilient sidewall, and wherein the air is contained within the inflatable element to separate the air from the product and to urge the inflatable element to fill a void within the volume created by evacuating a portion of the product from within the plastic squeeze bottle, the improvement comprising in combination:

a valve body having a seal surface and a first orifice, the first orifice extending through the valve body and the seal surface for passing the air flowing from the exterior of the plastic squeeze bottle through the valve body and through the seal surface;

a flow port extending through the valve body and the seal surface, at a first point which is distal from the first orifice, for passing the air through the seal surface and the valve body, and into the inflatable element;

a diaphragm disposed for pressing against the seal surface between the first orifice and the flow port in response to positive pressures within the inflatable element, and for lifting from the seal surface between the first orifice and the flow port in response to the negative pressures within the plastic squeeze bottle;

wherein lifting the diaphragm from the seal surface in response to the negative pressures within the plastic squeeze bottle passes the air from the exterior of the plastic squeeze bottle through the first orifice, across the seal surface, through the flow port, and into the inflatable element; and wherein pressing the diaphragm into the seal surface in response to the positive pressures within the inflatable element seals between the flow port and the first orifice, to seal air within the inflatable element.

6. The improvement of claim 5, wherein the flow port comprises:

notch formed into an edge of the seal surface of the valve body, and extending through an edge of the valve body for passing the air therethrough and into the inflatable element in response to the negative pressures within the plastic squeeze bottle.

7. The improvement of claim 5, wherein the flow port comprises:

a second orifice extending from the seal surface and interiorly through the valve body to a second point on the valve body which is interiorly disposed within the plastic squeeze bottle in flow communication with the interior of the inflatable element for passing air from between the diaphragm and the seal surface, and into the inflatable element in response to the negative pressures within the plastic squeeze bottle.

8. The improvement of claim 5, wherein the flow port comprises:

a second orifice extending from the seal surface and interiorly through the valve body to a second point on the valve body which is interiorly disposed within the plastic squeeze bottle in flow communication with the interior of the inflatable element for passing air from between the diaphragm and the seal surface, and into the inflatable element in response to negative pressures within the plastic squeeze bottle; and wherein a portion of the flow port extends in the same direction as the first orifice.

9. The improvement of claim 5, wherein the flow port comprises:

a second orifice extending from the seal surface and interiorly through the valve body to a second point on the valve body which is interiorly disposed within the plastic squeeze bottle in flow communication with the interior of the inflatable element for passing air from between the diaphragm and the seal surface, and into the inflatable element in response to the negative pressures within the plastic squeeze bottle; and wherein a portion of the flow port extends in the same direction as the first orifice for passing air from the flow port and into the inflatable element in the same direction as the air flows from the first orifice and through the seal surface.

10. The improvement of claim 5, wherein the flow port comprises:

a second and third orifices extending interiorly through the valve body, the second orifice extending from the first point on the seal surface which is distal from the first orifice, and the third orifice extending from the second orifice at second point, which is distal from the first point, to a third point which is within the plastic squeeze bottle for passing air from between the diaphragm and the seal surface and into the inflatable element in response to the negative pressures within the plastic squeeze bottle.

11. The improvement of claim 5, wherein the diaphragm is pressed against the seal surface to seal around both a first periphery defined by the first orifice and second periphery defined by the flow port.

12. In a product dispenser of the type having a plastic squeeze bottle with a bottom, a top and a resilient sidewall which define a volume for containing a product therein, a dispensing orifice which extends through the top of the plastic squeeze bottle for passing the product from the volume to an exterior of the plastic squeeze bottle, an inflatable element having an expandable wall disposed within the plastic squeeze bottle for receiving air from the exterior of the plastic squeeze bottle and expanding against the resilient sidewall in response to negative pressures caused by releasing external pressure applied to the resilient sidewall, and wherein the air is contained within the inflatable element to separate the air from the product and to urge the inflatable element to fill a void within the volume created by evacuating a portion of the product from within the plastic squeeze bottle, the improvement comprising in combination:

a valve body disposed at the bottom of the plastic squeeze bottle, the valve body having a flat surface disposed within the plastic squeeze bottle, and a first orifice extending through the valve body and the flat surface for passing the air flowing from an exterior of the plastic squeeze bottle;

a flow port extending through the flat surface and the valve body on the same side of the flat surface which the first orifice extends, and extending from the flat surface at a first point which is distal from the first orifice, for passing the air through the flat surface and the valve body, and into the inflatable element;

a diaphragm disposed for pressing against the flat surface between the first orifice and the flow port in response to positive pressures within the inflatable element, and for lifting from the flat surface between the first orifice and the flow port in response to the negative pressures within the squeeze bottle; and wherein lifting the diaphragm from the flat surface in response to the negative pressures within the inflatable element passes the air flowing from the exterior of the plastic squeeze bottle through the first orifice, across the flat surface, through the flow port, and into the inflatable element; and wherein pressing the diaphragm into the flat surface in response to the positive pressures within the inflatable element seals between the flow port and the first orifice, to seal air within the inflatable element.

13. The improvement of claim 12, wherein the valve body is integrally formed into the bottom of the plastic squeeze bottle.

14. The improvement of claim 12, wherein the diaphragm is pressed against the flat surface to seal around both a first periphery defined by the first orifice and second periphery defined by second flow port.

15. The improvement of claim 12, wherein the flow port comprises:

a notch formed into an edge of the flat surface of the valve body, and extending through the edge of the valve body for passing the air therethrough and into the inflatable element in response to the negative pressures within the plastic squeeze bottle.

16. The improvement of claim 12, wherein the flow port comprises:

a second orifice extending from the flat surface and interiorly through the valve body to a second point on the valve body which is interiorly disposed within the plastic squeeze bottle in flow communication with the interior of the inflatable element for passing air from between the diaphragm and the flat surface, and into the inflatable element in response to the negative pressures within the plastic squeeze bottle.

17. The improvement of claim 12, wherein the flow port comprises:

a second orifice extending from the flat surface and interiorly through the valve body to a second point on the valve body which is interiorly disposed within the plastic squeeze bottle in flow communication with the interior of the inflatable element for passing air from between the diaphragm and the flat surface, and into the inflatable element in response to negative pressures within the plastic squeeze bottle; and wherein a portion of the flow port extends in the same direction as the first orifice.

18. The improvement of claim 12, wherein the flow port comprises:

a second orifice extending from the flat surface and interiorly through the valve body to a second point on the valve body which is interiorly disposed within the plastic squeeze bottle in flow communication with the interior of the inflatable element for passing air from between the diaphragm and the flat surface, and into the inflatable element in response to the negative pressures within the plastic squeeze bottle; and wherein a portion of the flow port extends in the same direction as the first orifice for passing air from the flow port and into the inflatable element in the same direction as the air flows from the first orifice and through the flat surface.

19. The improvement of claim 12, wherein the flow port comprises:

a second and third orifices extending interiorly through the valve body, the second orifice extending from the first point on the flat surface which is distal from the first orifice, and the third orifice extending from the second orifice at second point, which is distal from the first point, to a third point which is within the plastic squeeze bottle for passing air from between the diaphragm and the flat surface and into the inflatable element in response to the negative pressures within the plastic squeeze bottle.

20. A method for dispensing a product from a product dispenser of the type having a plastic squeeze bottle with a bottom, a top and a resilient sidewall which define a volume for containing a product therein, a dispensing orifice which extends from within the plastic squeeze bottle for passing the product from the volume to an exterior of the plastic squeeze bottle, an inflatable element having an expandable wall disposed within the plastic squeeze bottle for receiving air from the exterior of the plastic squeeze bottle and expanding against the resilient sidewall in response to negative pressures caused by releasing external pressure applied to the resilient sidewall, and wherein the air is contained within the inflatable element to separate the air from the product and to urge the inflatable element to fill a void within the volume created by evacuating a portion of the product from within the plastic squeeze bottle, the method comprising in combination the steps of:

providing a valve body with a seal surface, a first orifice extending through the valve body and the seal surface for passing the air flowing from the exterior of the plastic squeeze bottle, a flow port extending through the valve body and the seal surface for passing the air through the valve body and into the inflatable element, a diaphragm disposed for pressing against the seal surface between the first orifice and the flow port in response to positive pressures within the inflatable element, and the diaphragm further disposed for lifting from the seal surface between the first orifice and the flow port in response to the negative pressures within the squeeze bottle;

squeezing a resilient sidewall of the product dispenser with the external pressure to reduce the volume defined therein which urges an initial part of the product to evacuate the product dispenser and creates the positive pressures which press the diaphragm against the seal surface to seal the air within the inflatable element;

passing an initial part of the product through the dispensing orifice in response to the positive pressures to evacuate the initial part of the product from the volume defined within product dispenser;

releasing external pressure from the resilient sidewall of the product dispenser to create negative pressures within the product dispenser, which lifts the diaphragm from the seal surface;

passing the ambient air from the exterior of plastic squeeze bottle, through the first orifice, between the diaphragm and the seal surface, through the flow port, and into the inflatable element to fill the volume defined within the product dispenser in response to the negative pressures;

expanding the inflatable element, which conforms to an interior shape of the product dispenser to fill with the air a portion of the volume evacuated by the initial part of the product and separate the product from the air within the inflatable element; and pressing the diaphragm into the seal surface between the flow port and the first orifice to seal air within the inflatable element in response to a state of equilibrium providing positive pressures within the inflatable element.

* * * * *